US008099911B2

(12) United States Patent
Anticich et al.

(10) Patent No.: US 8,099,911 B2
(45) Date of Patent: Jan. 24, 2012

(54) JAMB FLASHING

(75) Inventors: Michael Anticich, Kaiapoi (NZ); Stephen John Hotton, Kaiapoi (NZ)

(73) Assignee: Flashman Flashing Systems Limited (NZ)

( * ) Notice: Subject to any disclaimer, the term of this patent is extended or adjusted under 35 U.S.C. 154(b) by 76 days.

(21) Appl. No.: 12/522,430

(22) PCT Filed: Dec. 21, 2007

(86) PCT No.: PCT/NZ2007/000395

§ 371 (c)(1),
(2), (4) Date: Jul. 8, 2009

(87) PCT Pub. No.: WO2008/085067

PCT Pub. Date: Jul. 17, 2008

(65) Prior Publication Data

US 2010/0037534 A1 Feb. 18, 2010

(30) Foreign Application Priority Data

Jan. 9, 2007 (NZ) ..... 552504

(51) Int. Cl.
*E04D 1/36* (2006.01)

(52) U.S. Cl. ..... 52/58; 52/204.53; 52/211; 52/846

(58) Field of Classification Search ..... 52/58–62, 52/204.53, 211, 213, 215, 302.6, 656.1, 656.2, 52/656.4, 656.5, 656.6, 204.55, 214, 846
See application file for complete search history.

(56) References Cited

U.S. PATENT DOCUMENTS

| | | | | |
|---|---|---|---|---|
| 2,741,345 | A * | 4/1956 | Herr | 52/211 |
| 3,160,926 | A * | 12/1964 | Brose | 49/401 |
| 3,974,606 | A * | 8/1976 | LaBorde | 52/288.1 |
| 4,165,589 | A * | 8/1979 | de Carteret | 52/61 |
| 4,972,640 | A | 11/1990 | DiFazio | |
| 5,596,851 | A * | 1/1997 | Ting | 52/211 |
| 6,244,001 | B1 | 6/2001 | Anastasi | |

(Continued)

FOREIGN PATENT DOCUMENTS

DE 3420897 A1 * 5/1985

(Continued)

OTHER PUBLICATIONS

Derwent 2004-476815/45, Mar. 10, 2004, Jacosol Nederland.

*Primary Examiner* — Brian Glessner
*Assistant Examiner* — Adriana Figueroa
(74) *Attorney, Agent, or Firm* — Galbreath Law Offices, P.C.; John A. Galbreath

(57) ABSTRACT

A jamb flashing which includes a first plate, a second plate lying in a plane coplanar with or parallel to that of the first plate, and a flange the plane of which is substantially perpendicular to the planes of the first and second plates; said first plate having a first longitudinal edge which is upturned to lie at an acute angle to the plane of said first plate, and a second longitudinal edge which is rigidly secured to the lower edge of said flange; said second plate having a first longitudinal edge which is rigidly secured to the lower edge of said flange; said flange and said upturned first longitudinal edge of said first plate both projecting from the same side of the jamb flashing.

2 Claims, 4 Drawing Sheets

U.S. PATENT DOCUMENTS

| | | | | |
|---|---|---|---|---|
| 6,381,911 | B1 * | 5/2002 | Weiland | 52/215 |
| 6,526,709 | B1 * | 3/2003 | Jacobsen | 52/211 |
| 6,532,705 | B1 * | 3/2003 | Gorman | 52/213 |
| 7,448,154 | B1 * | 11/2008 | Kludt | 40/446 |
| 2007/0193126 | A1 * | 8/2007 | Teodorovich | 52/58 |

FOREIGN PATENT DOCUMENTS

| | | | |
|---|---|---|---|
| DE | 3801172 | A1 * | 7/1989 |
| EP | 288673 | | 10/1991 |
| FR | 2588034 | A1 * | 4/1987 |
| WO | WO98/22682 | | 5/1998 |

* cited by examiner

JAMB FLASHING

TECHNICAL FIELD

The present invention relates to an improved jamb flashing for use in combination with frames such as window frames. The flashing of the present invention has been developed specifically for use in combination with aluminium window frames, and therefore will be described with particular reference to this application. However, it should be appreciated that the flashing of the present invention is not restricted to this application, and in the specification, the term "windows" includes doors, French windows, sliding doors and also all similar components; the frames may be made of any material e.g. aluminium, plastics, wood.

BACKGROUND ART

A common method of building construction is to erect a building frame (typically of wood), cover the frame with a layer of building paper on the exterior of the building, and then apply cladding over the building paper. The cladding may be any of a wide variety of materials, e.g. plaster-based preparations, sheets of simulated or synthetic stone, weatherboard, fibre cement or polystyrene.

The frames for windows are set into the framing, and the cladding butts up against the edges of each window frame. The join between the cladding and each vertical side edge of the window frame usually is sealed with a known sealant compound. This technique is capable of providing an efficient seal, but only if the sealant is applied carefully, using the correct technique, and if the underlying materials are clean and dry. Unfortunately, under the sort of conditions which often prevail on building sites, the sealant often is applied incorrectly and/or to poorly prepared underlying materials; this results in an inadequate seal which leaks in use, and this can cause rotting of the building frame.

DISCLOSURE OF INVENTION

It is therefore an object of the invention to provide a jamb flashing which is easy to use and which provides an effective seal at the junction between the cladding and the vertical side edges of the frame.

The present invention provides a jamb flashing which includes a first plate, a second plate lying in a plane coplanar with or parallel to that of the first plate, and a flange the plane of which is substantially perpendicular to the planes of the first and second plates; said first plate having a first longitudinal edge which is upturned to lie at an acute angle to the plane of said first plate, and a second longitudinal edge which is rigidly secured to the lower edge of said flange; said second plate having a first longitudinal edge which is rigidly secured to the lower edge of said flange; said flange and said upturned first longitudinal edge of said first plate both projecting from the same side of the jamb flashing.

Preferably, the first and second plates are co-planar. Preferably also, the first and second plates and the flange are integrally formed.

BRIEF DESCRIPTION OF DRAWINGS

By way of example only, a preferred embodiment of the present invention is described in detail with reference to the accompanying drawings, in which:—

BEST MODE FOR CARRYING OUT THE INVENTION

Figure 1:
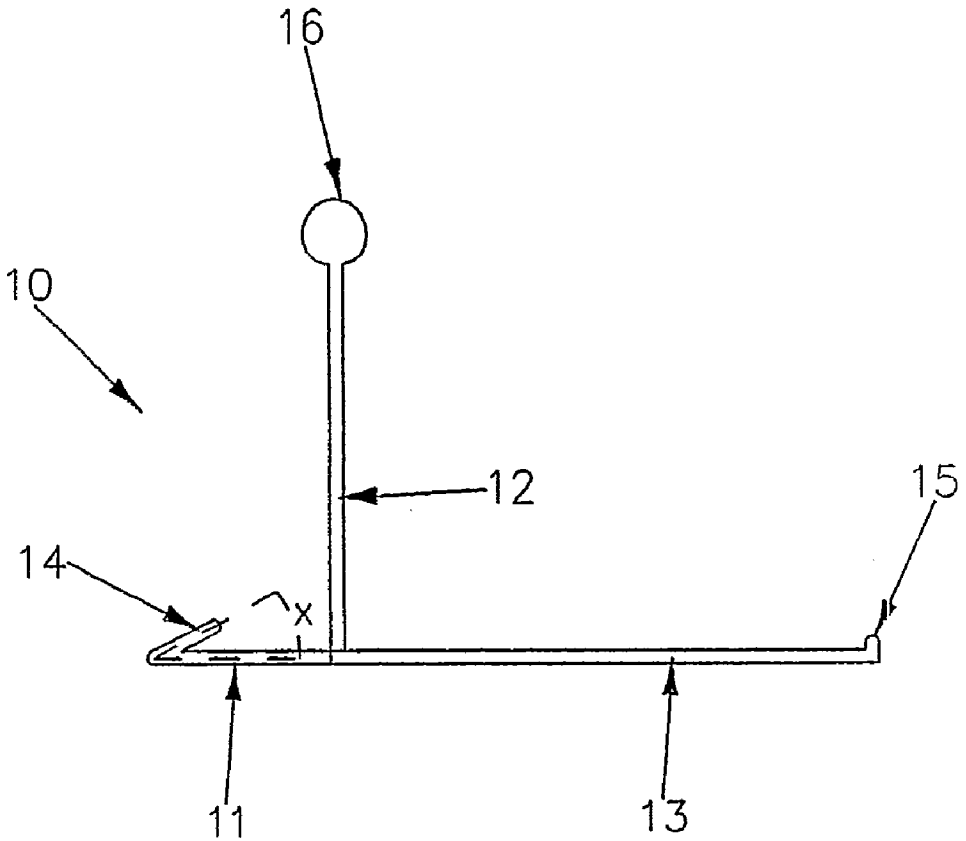
FIG. 1 shows a cross section through a jamb flashing in accordance with the present invention.

Referring to the drawings, a jamb flashing 10 includes a first plate 11, a flange 12 and a second plate 13. The first and second plates 11, 13 are co-planar, and the plane of the flange 12 is substantially perpendicular to the plane of the plates 11, 13. The free edge 14 of the first plate 11 is turned up to lie at an acute angle X to the plane of the plate 11.

The free edge 15 of the plate 13 is upturned. The free edge 16 of the flange 12 is formed as a rounded bead.

Figure 2:
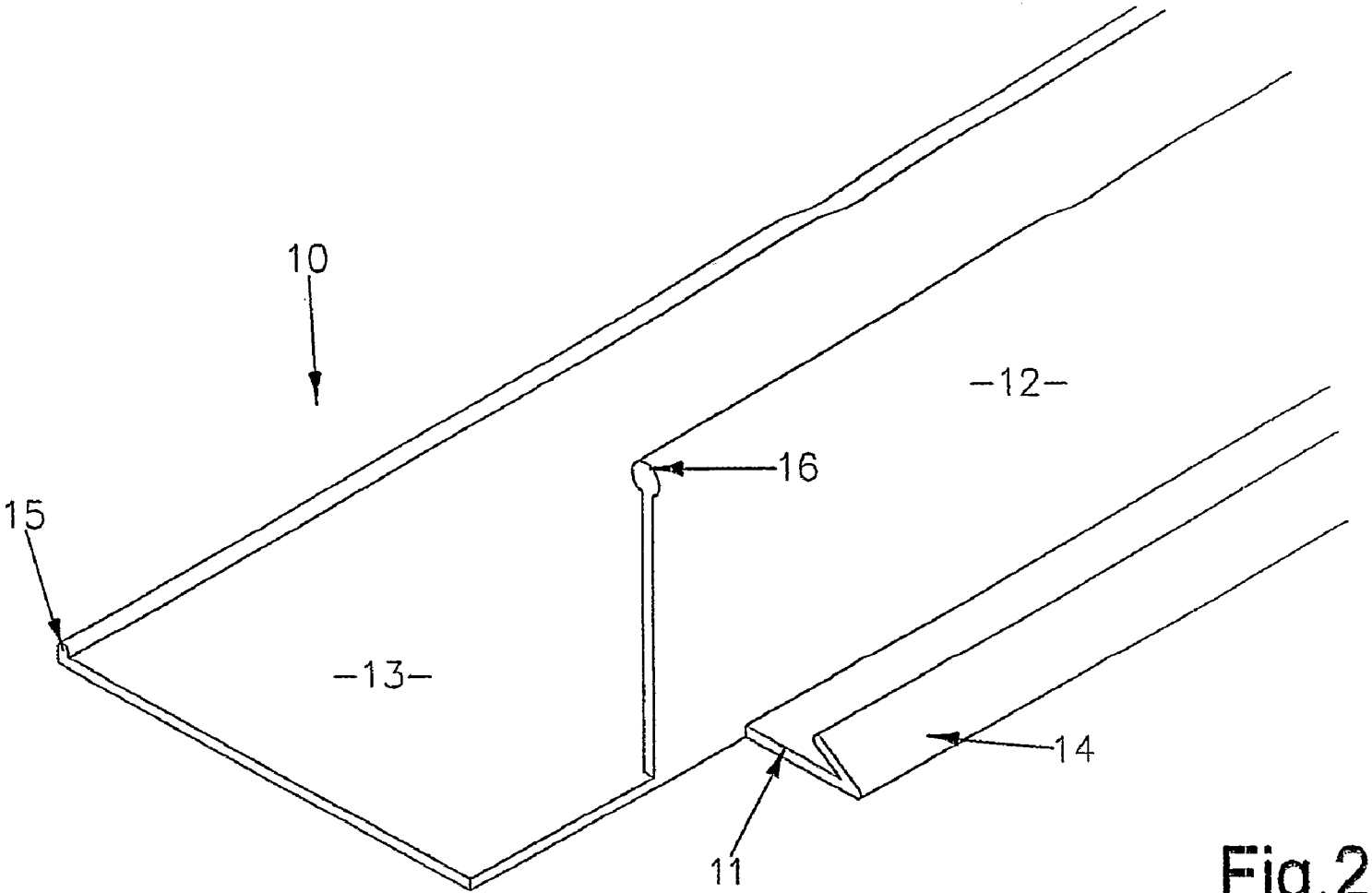
FIG. 2 shows an isometric view of one end of a length of jamb flashing.

Preferably, the jamb flashing 10 is formed as a one-piece extrusion. However, for fitting to a specified window cavity, the plates 11, 13 and the flange 12 may be cut to different lengths, so that the jamb flashing fits with any other flashings used to surround the window frame. For example, if the jamb flashing of the present invention is used in combination with the sill flashing disclosed in NZ patent number 550346 and the cavity head flashing disclosed in NZ patent number 542982, then, as shown in FIG. 2, at the top of the flashing, the first plate 11 is cut shorter than the flange 12, which in turn is cut shorter than the second plate 13.

It will be appreciated that the jamb flashing of the present invention may also be used on its own or in combination with other sill and head flashings.

Figure 3:
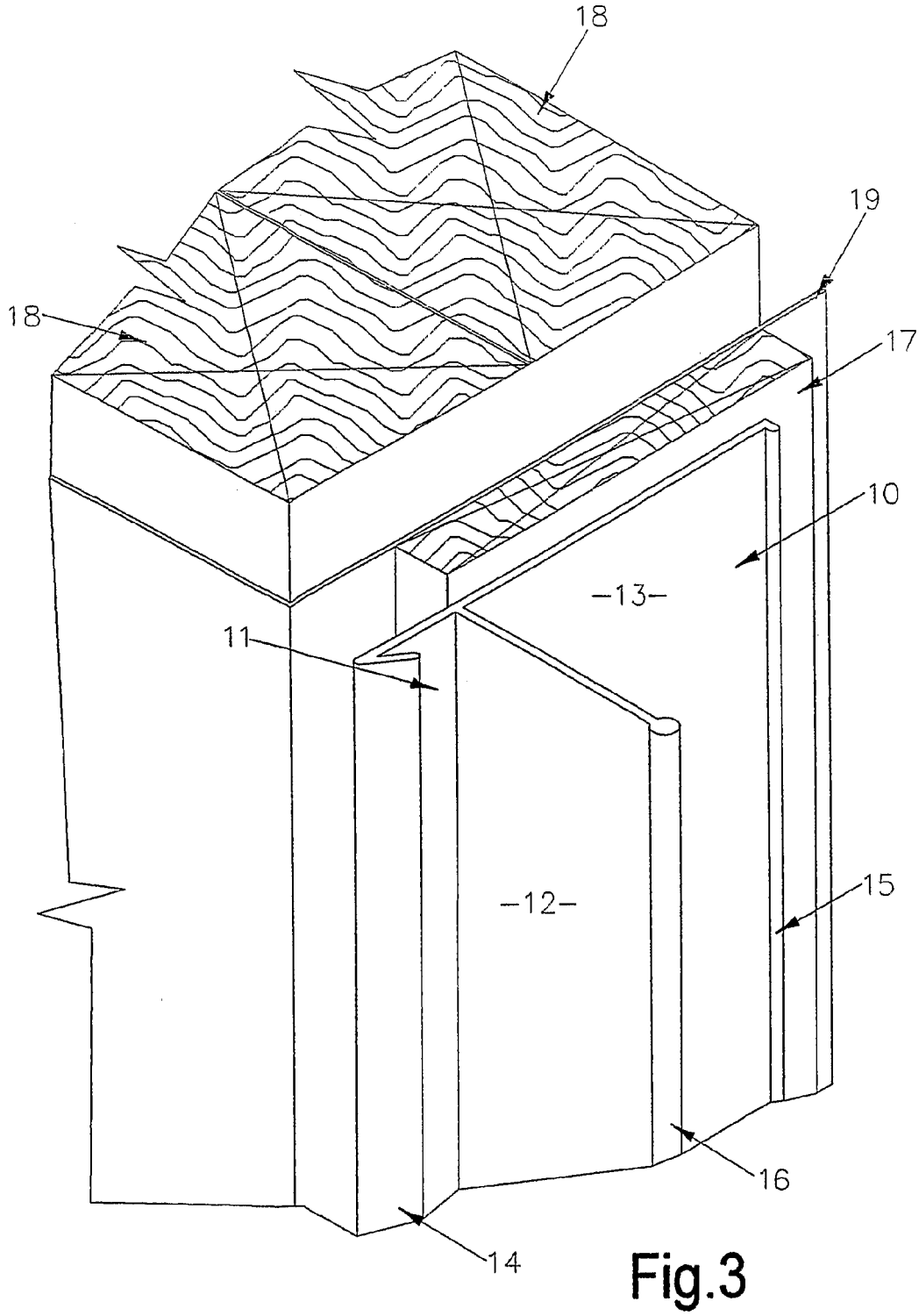
FIG. 3 is an isometric view showing a length of jamb flashing secured to the framing.
Figure 4:
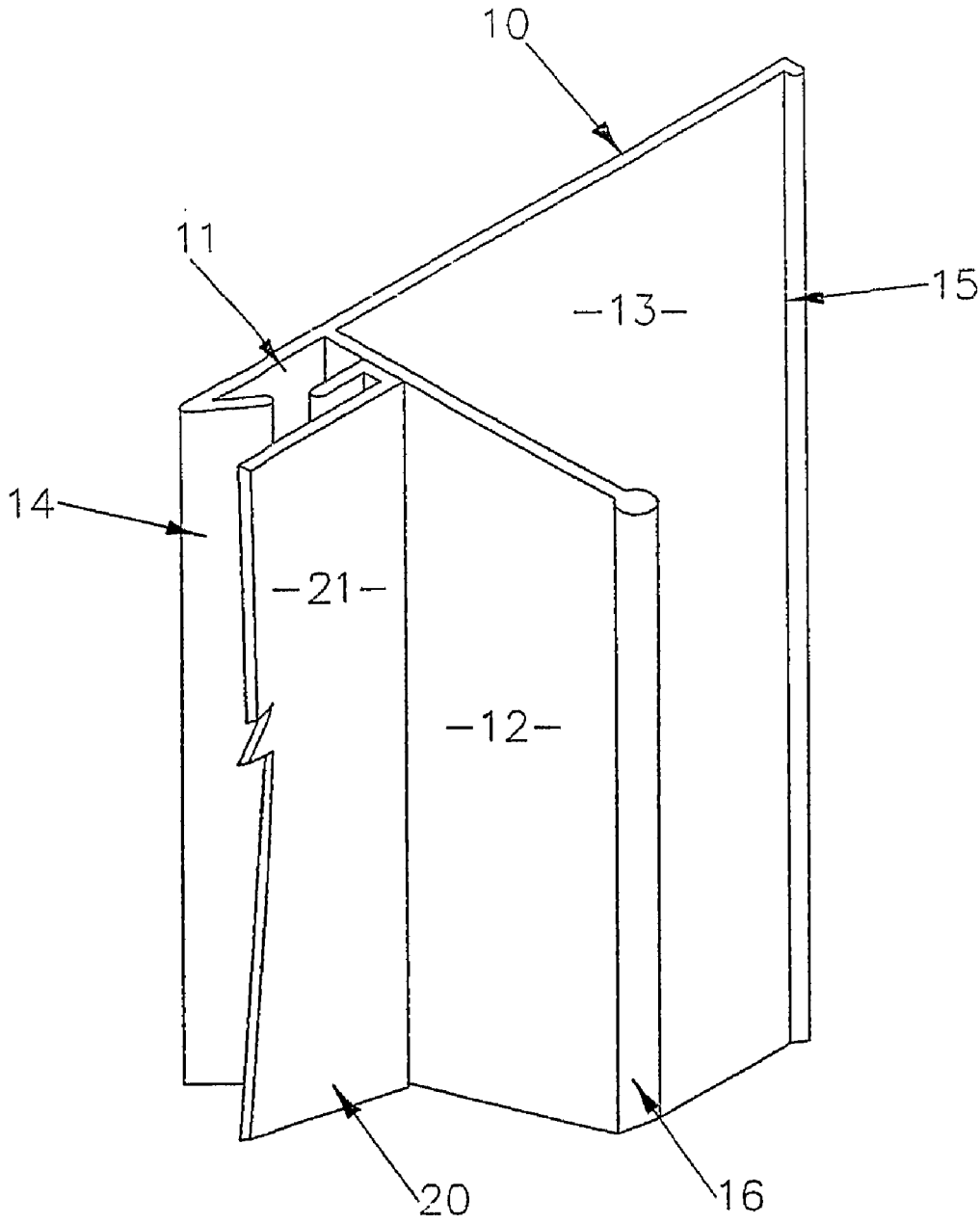
FIG. 4 is an isometric view showing part of a window frame in position against the jamb flashing.

As shown in FIG. 3, in use the jamb flashing 10 of the present invention is supported on the vertical side of a window cavity with at least part of the second plate 13 supported by, and secured to, a batten 17 and the first plate 11 extending outwards into the window cavity so that it lies behind the vertical edge of the window frame; as shown in FIG. 4.

The batten 17 is placed over the front face of the studs 18 and is used to secure a layer of building paper 19 over the studs. The plate 13 is secured to the batten 17 in any suitable way e.g. nailing, screwing.

When the cladding is applied to the building, the cladding overlies the second plate 13 and the inner edge of the cladding abuts the side of the flange 12. Thus, any water which finds its way between the flange 12 and the edge of the cladding is prevented from reaching the framing by the second plate 13, and tends to trickle down on the second plate 13 onto the windowsill or the sill flashing. The height of the flange 12 can be varied to suit different claddings, so that the flange 12 extends approximately the thickness of the cladding.

As shown in FIG. 4, a window frame 20 is arranged with each vertical side 21 parallel to the plate 11 of the flashing 10, but spaced from the plate 11 by the upturned edge 14 of the flashing. Any water which penetrates between the side of the flange 12 and the vertical edge of the window frame contacts the first plate 11 and is prevented from penetrating into or behind the frame by the presence of the angled edge 14; any such water simply trickles down the first plate 11 onto the sill or the sill flashing.

In the above described embodiment, the plates 11, 13 have been described as co-planar, but it would also be possible to form the jamb with a step, such that the plates 11, 13 lie in parallel planes but are not co-planar. The upturned free edge 15 of the plate 13 is advantageous, in that it helps to space the cladding away from the plate 13. However, the upturned edge is not necessary for some types of cladding. The free edge 16 of the flange 12 may be cut straight or formed into a range of decorative shapes. The angle X between the edge 14 and the plane of the plate 11 may be any acute angle.

The invention claimed is:

1. A jamb flashing which includes a first plate, a second plate lying in a plane coplanar with that of the first plate, and a flange the plane of which is substantially perpendicular to the plane of the first and second plates; said first plate having a first longitudinal edge which is upturned to lie at an acute angle to the plane of said first plate, and a second longitudinal edge which is rigidly secured to the lower edge of said flange; said second plate having a first longitudinal edge which is rigidly secured to the lower edge of said flange and a second longitudinal edge which is upturned; said flange, said upturned first longitudinal edge of said first plate and said second longitudinal edge of said second plate all projecting from the same side of the jamb flashing; the upper edge of said flange being substantially further away from said first and second plates than either said first longitudinal edge of said first plate or said second longitudinal edge of said second plate; and the second longitudinal edge of said second plate projecting above the plane of the second plate no further than said first longitudinal edge of said first plate.

2. The jamb flashing as claimed in claim 1, wherein said first and second plates and said flange are integrally formed.

* * * * *